US007131309B2

(12) United States Patent
Burton et al.

(10) Patent No.: US 7,131,309 B2
(45) Date of Patent: Nov. 7, 2006

(54) BENDING SYSTEM

(75) Inventors: David Burton, Guelph (CA); Nat Rea, Woodbridge (CA)

(73) Assignee: Martinrea International Inc., Vaughan (CA)

( * ) Notice: Subject to any disclaimer, the term of this patent is extended or adjusted under 35 U.S.C. 154(b) by 2 days.

(21) Appl. No.: 10/863,380

(22) Filed: Jun. 9, 2004

(65) Prior Publication Data

US 2005/0145003 A1 Jul. 7, 2005

(51) Int. Cl.
*B21D 7/12* (2006.01)

(52) U.S. Cl. ..... 72/306; 72/149; 72/217

(58) Field of Classification Search ..... 72/306, 72/307, 149, 217, 311, 405.09, 405.12, 405.03
See application file for complete search history.

(56) References Cited

U.S. PATENT DOCUMENTS 3,916,665 A * 11/1975 Hancock ..... 72/306
4,681,210 A * 7/1987 Miki et al. ..... 198/468.2
4,959,984 A * 10/1990 Trudell et al. ..... 72/19.9
5,357,778 A * 10/1994 Tsai ..... 72/306
5,673,585 A * 10/1997 Bishop ..... 72/447
5,852,945 A * 12/1998 Burger ..... 72/306
6,167,740 B1 * 1/2001 Lipari et al. ..... 72/306
6,557,235 B1 * 5/2003 Katz et al. ..... 29/563

* cited by examiner

*Primary Examiner*—Daniel C. Crane
(74) *Attorney, Agent, or Firm*—Dimock Stratton LLP; Mark B. Eisen

(57) ABSTRACT

A bending system comprising a series of bending stations, each equipped with a bending head. Workpieces are conveyed from one bending station to the next by grippers suspended from a two-axis gantry, that preferably grasp the workpiece at an intermediate portion. Each bending head grasps the tube at a different intermediate position, and in the preferred embodiment each bending station is capable of rotating to position the bending dye such that the free end of the workpiece being bent can be oriented in the bending plane without interference by an adjacent bending station. These features reduce the space requirements of the system considerably. A multi-level dispensing apparatus may be provided to load the bending heads. The bending system is preferably operated by computer, allowing the bending of long workpieces to precise configurations under the control of a single operator.

20 Claims, 6 Drawing Sheets

BENDING SYSTEM

FIELD OF THE INVENTION

This invention relates to industrial equipment. In particular, this invention relates to a bending system for bending wires, tubes and other elements, for example for use as components in manufacturing.

BACKGROUND OF THE INVENTION

Bent components are used in manufacturing many different types of articles and machines. For example, many of the fluid conduits in an automobile are bent to a predetermined shape for installation on an automobile assembly line. In such situations the component must be shaped to exacting tolerances, particularly in the case of for example brake lines which carry brake fluid from the master braking cylinder to the wheel cylinders, in order to ensure that the conduits fit into the space for which they are designed and conduits are stable in motion.

One popular bending method is known as "draw bending", in which the workpiece is held in position and bent by a bending arm around a dye having a set radius of curvature. Where multiple bends are required in different directions, rather than changing the direction of motion of the bending arm and the orientation of the dye, after each bend the workpiece is rotated to the next bending plane so that the bend can be effected by actuating the bending arm in the same direction, to the desired angle. Such a device is known as a "rotary draw bender."

To bend components within very high tolerances, rotary bending heads have been developed that combine different types of actuators, for example a hydraulic gripper for gripping the tube can be combined with an electric motor for rotating the tube to the bending plane and pneumatic or hydraulic actuators for effecting the actual bending of the tube by the bending arm.

A conventional rotary bending head comprises a set of jaws for gripping one end of the tube; a bending arm extending forwardly of the jaws and having a grasping end, for holding the tube during bending and rotation; and a dye having a specific bending radius movable to the bending point on the tube, the dye being sized depending upon the diameter of the tube and the desired radius of curvature of the bend. The arc of motion of bending arm is limited to the bending plane, so the tube is rotated until the desired bend direction falls into the bending plane, at which point the bending arm is actuated to effect the bend to the desired angle. In a typical case this process occurs multiple times on a particular tube, for example in the case of a brake line.

However, such prior art rotary bending heads have significant limitations. The time that it takes to apply multiple bends to a tube depends upon a number of factors, including the rotational speed of the bending jaws. Prior to each bend, the jaws must rotate the tube to an angular orientation in which the desired bend direction lies in the bending plane. This rotation cannot commence until the previous bend is completed, and in order to maintain precise tolerances the rotation must completely cease before the next bend begins. In the case of a tube to which multiple bends are to be applied, the time spent rotating the tube to the bending position for each successive bend can constitute the majority of the time taken to complete the bending process. In industries such as the automobile parts industry, where a typical run through the bending apparatus to fill a single order can involve hundreds of thousands of tubes, this wasted time can have a significant unnecessary overhead cost.

Moreover, the tube bending head so described as capable of bending tubes only up to a certain length, i.e. approximately 1.3 meters (4 feet), at the maximum rotational speed of the jaws. Because of the mechanical disadvantage obtained by grasping the tube at one end, in longer tubes the inertia of the free end of the tube will cause the tube to wobble, to the point where the tube is likely to be out of alignment at the moment the bend occurs, unless the rotational speed of the jaws is reduced. With the jaws rotating at maximum speed, as a long tube is rotated the free end of the tube tends to twist and lag behind the gripped end of the tube, so that the bending point may not have rotated fully into the bending plane at the precise moment that the bending arm is applied to the tube. Also, if the tube is heavy enough inertia can cause the tube to slip in the gripper at full speed. All of these problems result in reduced tolerance and, in many cases, inaccurate bends, which requires that many of the component be discarded. This problem is also wasteful and time consuming over many thousands or hundreds of thousands of workpieces.

It would accordingly be advantageous to provide a bending apparatus that is capable of maintaining high rotational speeds when rotating the tube into the bending plane over successive bends, without reducing the accuracy or tolerances in the finished product, and to be capable of bending tubes longer than 1.3 meters (4 feet) quickly and without reducing the accuracy or tolerances in the finished product.

Further, it would be advantageous to provide a series of bending heads in an apparatus, in order to effect bends of many different radii and complete the entire bending procedure without having to change the bending dye. However, positioning each bending stations far enough away from adjacent bending stations so that the workpiece can be bent without interference by an adjacent bending station would take up considerable floor space.

SUMMARY OF THE INVENTION

The present invention overcomes these disadvantages in a bending system which is capable of bending long tubes, wires and other elements into complex three dimensional configurations, with the same tolerances and precision as short tubes and without reducing the rotational speed of the bending head.

The invention accomplishes this by providing a series of bending stations, each equipped with a bending head. The workpieces are conveyed from bending station to bending station by grippers that preferably grasp the workpiece at an intermediate portion, rather than at one end. This reduces the length of workpiece from the gripping point to the free ends, commensurately reducing twisting and wobbling of the workpiece during bending and significantly diminishing the likelihood of slippage of the workpiece in the gripper during rotation.

The bending stations may also be spaced from one another a distance which is shorter than the length of a workpiece, because each bending head grasps the tube at a different intermediate position so the bending stations do not interfere with one another. Moreover, in the preferred embodiment each bending station is capable of rotating, to position the bending dye such that the free end of the workpiece being bent can be oriented in the bending plane without interference by an adjacent bending station. These features reduce the space requirements of the system considerably.

In the preferred embodiment a two-axis gantry is provided to convey a workpiece to each successive bending station after the previous bending station has completed its bending cycle (which may involve multiple bends). Also, in the preferred embodiment a multi-level dispensing apparatus is provided to load the bending heads. A movable loader arm can pick a workpiece off of any shelf of the dispensing apparatus, which increases the speed of operation by avoiding the need to wait for next workpiece to fall into the loading position on the shelf after a workpiece has been loaded to the first bending station.

The bending system is preferably operated by computer, so that parallel processing by multiple bending stations can be effected quickly and without interruption. The bending system according to the invention accordingly facilitates the bending of workpieces such as long tubes, wires and other elements to precise configurations under the control of a single operator, thus saving up to two-thirds of the labour involved in bending workpieces with a single bending head. The bending system of the invention is also relatively compact, since the bending stations can be closer together than the length of each workpiece, due to the versatility in the position at which the grippers grasp the workpiece and the ability to rotate each bending station to a position where it can bend a portion of the workpiece without interference by adjacent bending stations.

Moreover, bending of long tubes and wires can be effected without slippage of the tube in the gripper or inertial twisting or wobbling of the workpiece, thereby significantly reducing and even potentially eliminating the number of workpieces which must be discarded due to failure to meet tolerances.

The present invention thus provides a bending system, comprising a series of bending stations spaced from one another, each bending station comprising a bending head for bending a workpiece through a bending envelope defined along a bending plane, a series of grippers suspended from a gantry, for conveying the workpiece from one bending station to another bending station, and at least one of the bending heads being rotatable, to thereby adjust the position of the bending envelope relative to adjacent bending stations, whereby the bending head can be rotated to bend the workpiece without interference from adjacent bending stations.

The present invention further provides a bending system, comprising a series of bending stations spaced from one another, each bending station comprising a bending head for bending a workpiece through a bending envelope defined along a bending plane, a series of grippers suspended from a gantry, for conveying the workpiece from one bending station to another bending station, and a multi-level dispensing apparatus comprising a movable loader arm for picking a workpiece off of a shelf of the dispensing apparatus and conveying the workpiece to a gripper.

The present invention further provides a method of bending an elongated workpiece using a series of bending stations spaced from one another, each bending station comprising a bending head for bending a workpiece through a bending envelope defined along a bending plane, comprising the steps of: a. rotating at least one of the bending heads to position the bending envelope so that the workpiece can be bent without interference from adjacent bending stations, b. conveying the workpiece along the series of bending stations, and c. bending the workpiece as the workpiece is conveyed to each bending station.

BRIEF DESCRIPTION OF THE DRAWINGS

In drawings which illustrate by way of example only a preferred embodiment of the invention.

DETAILED DESCRIPTION OF THE INVENTION

The bending system of the invention will be described herein in the context of bending tubes 2, for example tubes used for fluid conduits in an automobile such as brake lines. However, it will be appreciated that the principles of the invention apply to bending any bendable elongated member, and the invention is not intended to be limited to any particular type of workpiece.

Figure 5A:
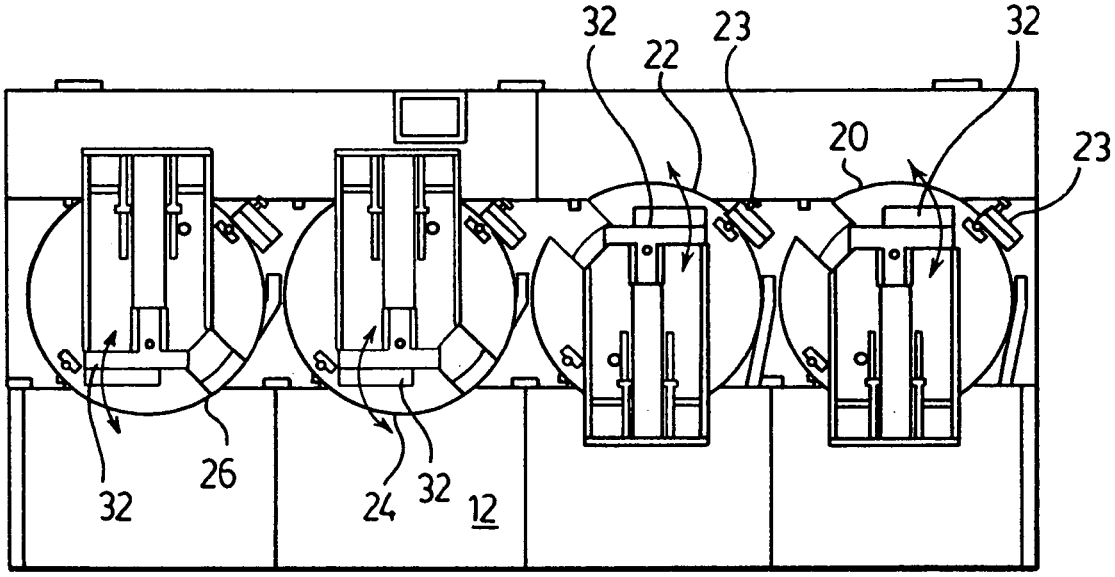
FIG. 5A is a top plan view of the bending stations in the bending system of FIG. 1.
Figure 5B:
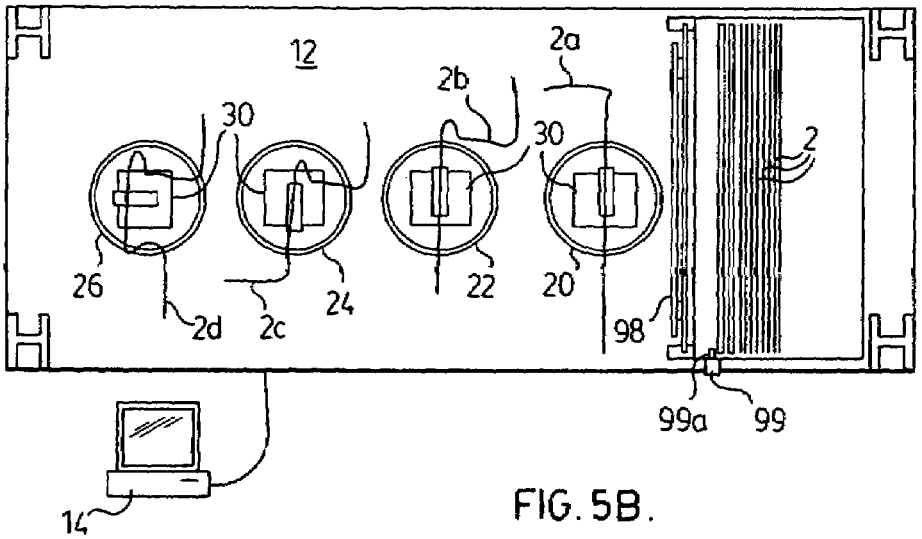
FIG. 5B is a schematic plan view of the bending stations during a bending run.
Figure 6:
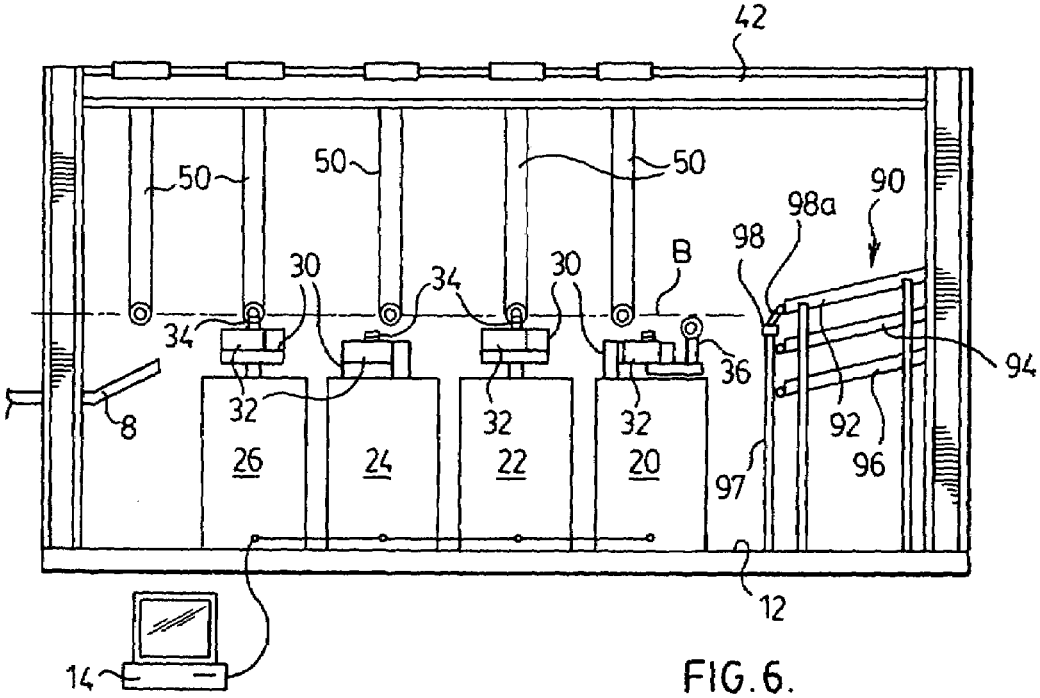
FIG. 6 is a schematic elevation of the bending system of FIG. 1.

The bending system 10 of the invention comprises a series of bending stations 20, 22, 24, 26, shown in FIGS. 5 and 6. There are four bending stations in the embodiment illustrated, however it will be appreciated that more or fewer bending stations may be employed, depending upon the complexity of the bending to be accomplished and the desired output of the system.

Each bending station comprises a pedestal 28, which is rotatably mounted into a floor 12 of the system 10, and a bending head 30 having a bending arm 32 that follows an arcuate path about a dye 34 along a bending plane B, as is conventional. The bending plane B in the embodiment illustrated (shown as a dotted line in FIG. 6) is generally horizontal and the bending stations 20, 22, 24 and 26 are preferably equally spaced along the floor 12 of the system 10, to simplify control requirements.

Figure 4:
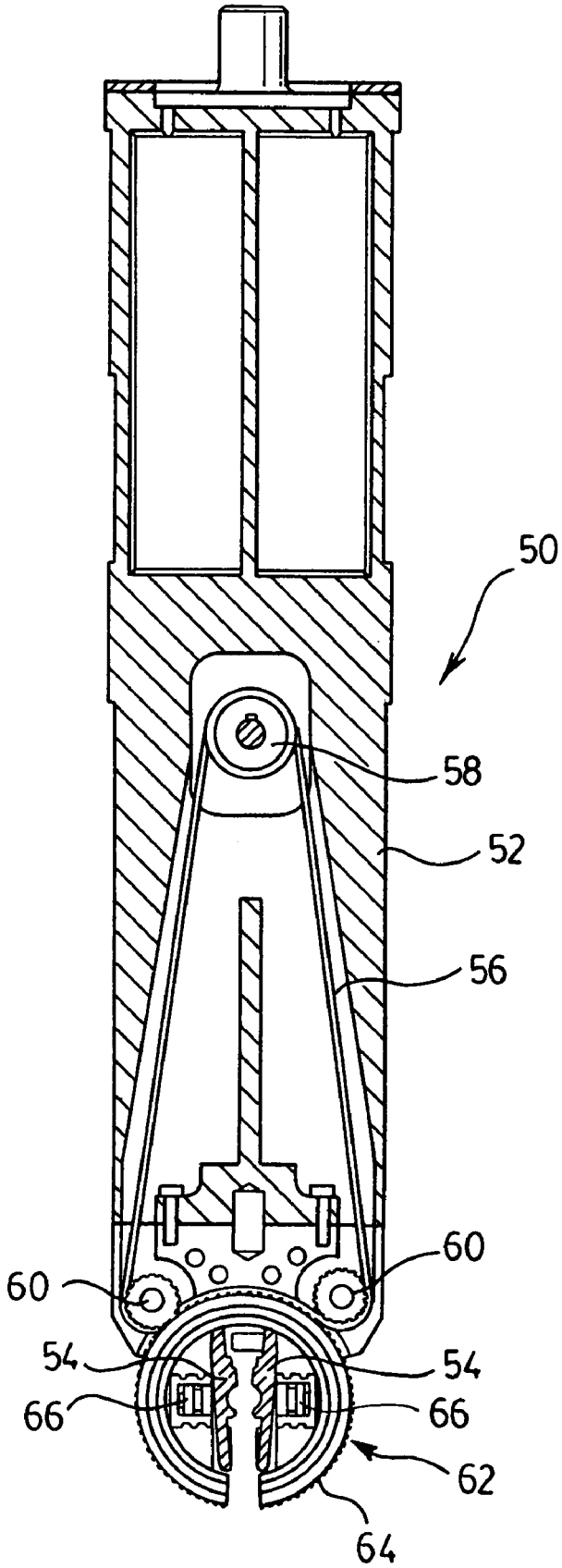
FIG. 4 is an elevational view of a gripping arm.

Tubes 2 are unloaded from a tube loader 90 and delivered to the first bending station 20, and then unloaded from each bending station and delivered to the next successive bending station, by a movable gripper 50, illustrated in detail in FIG. 4. The gripper 50 comprises a gripper arm 52 suspended from its upper end and gripper jaws 54 mounted to its lower end. The gripper jaws 54 are contained within a rotatable disk 62, which in the embodiment shown is rotated by a drive servo or mechanical drive 56 actuated by a servo motor (not shown) via pulley 58 and extending around bearings or sprockets 60 such that the servo or mechanical drive 56 is held engaged against a ribbed peripheral edge 64 of the gripper disk 62. The jaws 54 are actuated by pneumatic or hydraulic cylinders 66 contained within the disk 62, and the disk 62 is in turn rotatably mounted to the arm 52 by a bearing (not shown) engaging the peripheral edge.

Figure 1:
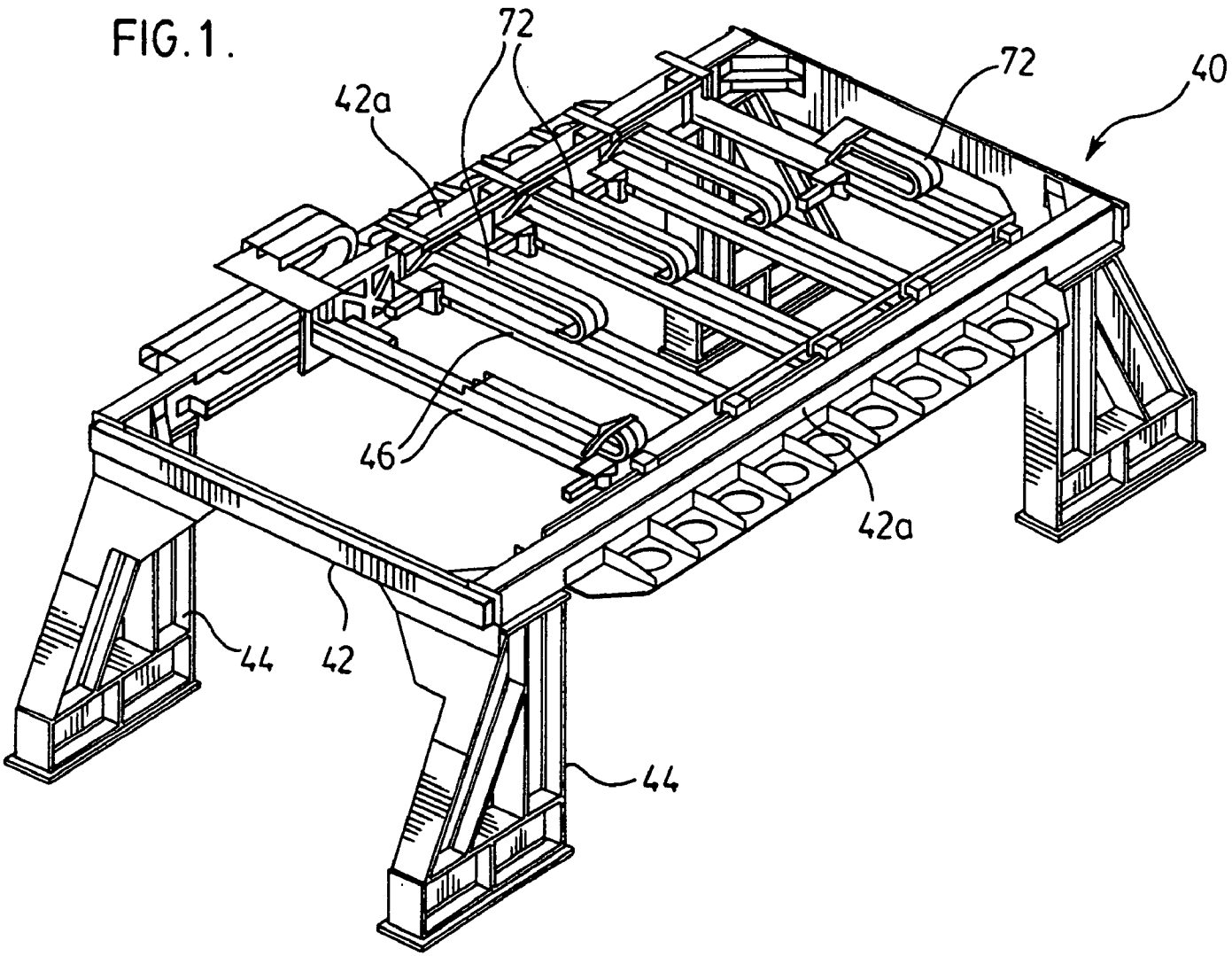
FIG. 1 is a perspective view of a two-axis gantry for the bending system of the invention, taken from above.
Figure 2:
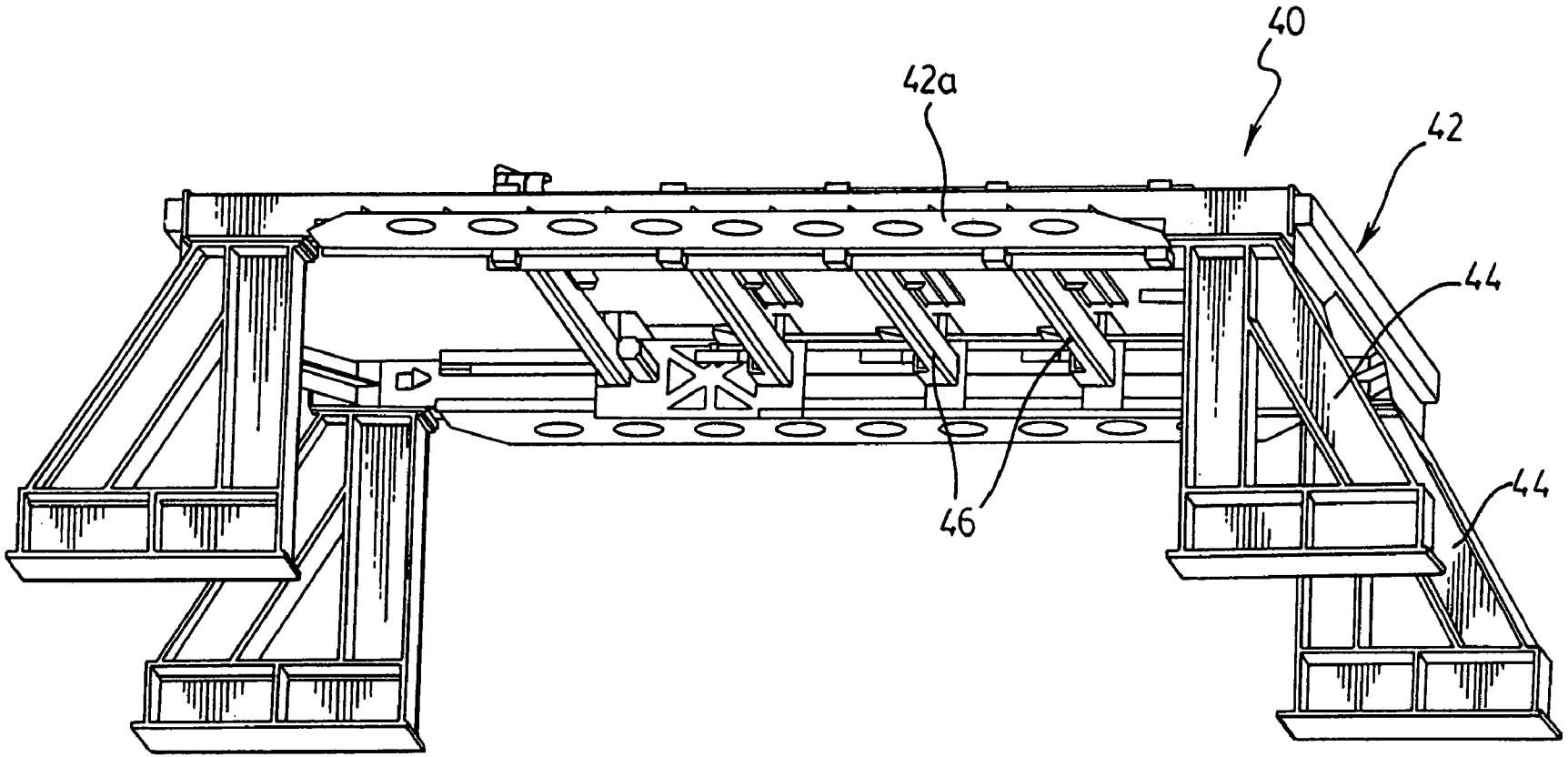
FIG. 2 is a perspective view of the gantry of FIG. 1, taken from below.
Figure 3:
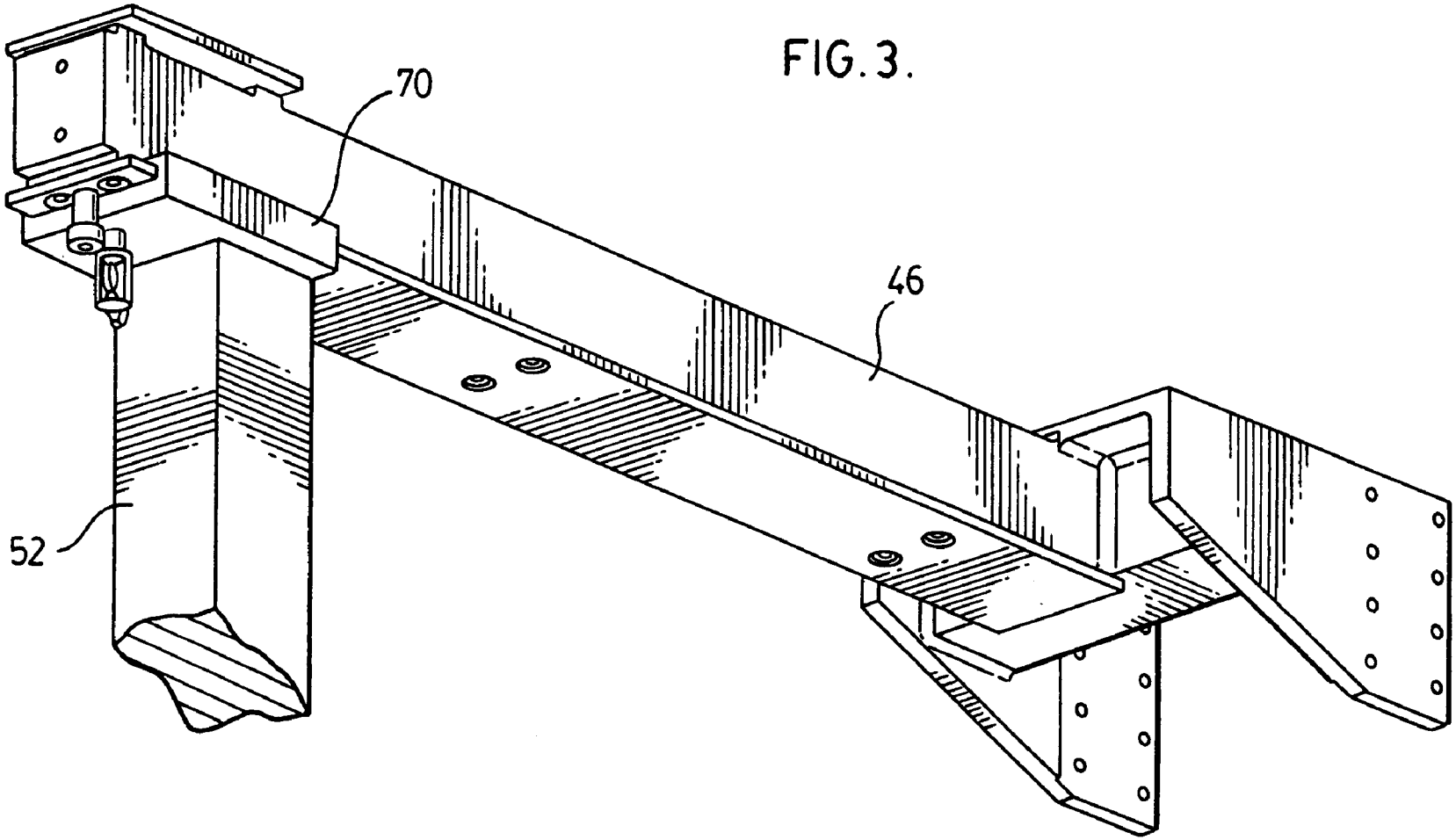
FIG. 3 is perspective view of a gripping arm suspension rail in the gantry of FIG. 1.

The movable gripper 50 is suspended from a two-axis gantry 40, illustrated in FIGS. 1 and 2. The gantry 40 comprises a main frame 42 supported by legs 44 and having, for each gripper 50 (five in the embodiment illustrated), a movable crossbeam 46, best seen in FIG. 3. The crossbeams 46 are slidably mounted to the side rails 42*a* of the frame 42 and movable along a first ("x") axis within a set range by an electric motor or other actuator (not shown) driving a pinion along a rack, or via any other suitable drive system. The particular drive system used to move the crossbeams 46 in the "x" direction along the gantry frame 42 is a matter of selection.

A gripper 50 is preferably provided for each bending station 20, 22, 24, 26 plus one extra gripper 50 for unloading from the last station 26 and depositing the bent workpiece 2 onto an unloading shelf or tray 8 (shown in FIG. 6). Each gripper 50 is independently movable longitudinally along the gantry 40, i.e. in the "x" direction, via the movable crossbeams 46, for unloading a tube 2 from the loader 90 or one bending station and delivering it to the next bending station or the unloading shelf 8. Each gripper 50 is also independently movable transversely across the gantry 40, along a second ("y") axis, by a sliding mount 70, best seen in FIG. 3, actuated by a servo or mechanical drive 72 (shown in FIG. 1). This allows the gripper 50 to load the tube 2 at a point where the jaws 54 can most conveniently grasp the tube 2 at an intermediate point for the next bend, which:

- allows the gripper 50 to longitudinally align the next bending point of the tube 2 with the dye 34;
- effectively doubles the length of tube 2 which can be rotated at a given speed without risking inertial twisting or wobbling of the workpiece or slippage at the gripper jaws 34;
- allows multiple bends to be effected at each bending station 20, 22, 24 or 26 before the tube 2 is unloaded and moved to the next bending station. After each bend the gripper jaws 54 rotate the tube 2 to the bending plane for the next successive bend and, if necessary, the bending head 34 is raised or lowered between bends to change the bend radius for successive bends by aligning the tube 2 with a different level of a multi-level bending dye 34; and
- allows the gripper 50 to grasp a partially bent tube 2 at the most convenient point of the tube 2 to maximize the use of the space around the bending stations 20, 22, 24, 26 because the tube 2 can be bent from either side of the gripper 50.

The sliding mount 70 may be moved by a servo or mechanical drive 72 as shown, or by a rack and pinion or any other suitable drive system, and the particular drive system used to move the sliding mount 70 in the "y" direction along the gantry frame 42 is a matter of selection.

Preferably the grippers 50 all move substantially in unison in the "x" direction. This simplifies synchronization of the loading and unloading of the various bending stations 20, 22, 24, 26 for efficient parallel processing.

For greater versatility, some of the grippers 50—particularly those loading and holding for the first two stations 20, 22 where the free ends of the tubes 2 are still quite long—may have a set of slip-jaws 36 disposed spaced from the dye 34 and preferably movable in the direction of the "y" axis independently of the gripper 50 (see bending station 20 in FIG. 6). The slip jaws 36 surround the tube 2 to retain it axially, but do not prevent the tube 2 from rotating. This further reduces unwanted wobbling of the tube 2 during the bending operation, by providing a second support point along the tube 2 spaced from the primary gripping point at the gripping jaws 54. For proper operation of the optional slip jaws 36 the workpiece 2, while held in a stable position, must be able to rotate completely freely within the slip-jaws 36 as any resistance to rotation of the tube 2 to the bending plane B may cause the tube to twist and potentially slip in the gripper jaws 54.

Rotation of the bending stations 20, 22, 24, 26 does not need to be controlled during the bending process, because each bending station 20, 22, 24, 26 can be rotated to the desired orientation manually before the bending process begins, based on the particular bends being performed by each particular bending station and the length and direction of the free ends of the tube 2 during the bending procedure, and is locked into the desired rotational position by a releasable latch or pin 23. Preferably each bending station 20, 22, 24, 26 also has some degree of vertical adjustability, for example four to six inches from the floor 12, allowing the station to accommodate multi-level bending dyes 34 of varying sizes without interfering with the operation of the gantry 40. This allows bends of different radii to be effected by a single bending station during each bending run, and reduces the need to change bending heads for different bending runs. In addition the bending head 30 itself moves along a vertical ("z") axis relative to the pedestal so that the bending dye 34 can be moved into the bending plane B (stations 22 and 26 in FIG. 6) for bending or retracted out of the path of the grippers 50 (stations 20 and 24 in FIG. 6) while tubes 2 are being moved between stations. The bending heads 30 can also be controlled to raise the bending dye 34 to a specific level, in order to align a particular level of a multi-level bending dye 34 with the level of the gripper 50 (i.e. the bending plane B).

Alternatively, or additionally, the grippers 50 could be designed to be extendable in the "z" direction, to move the workpiece 2 to the level of the bending dye 34. However, because it is preferable to move the workpiece 2 as little as possible during the bending operation to avoid unwanted inertial flexing and wobbling, it is advantageous to instead move the dye 34 to the level of the workpiece 2 as in the preferred embodiment shown.

Each bending head 30, crossbeam 46 and gripper 50 is operated by a computer 14, which directs the position and motion of the gripper 50; the angular orientation of the gripper jaws 54 through rotation of the servo motor (not shown) in the gripper arm 52; the opening and closing of the jaws 34 via pneumatic/hydraulic actuators 66; actuation of the bending arm 32; and the timing of the bending cycle at each station 20, 22, 24, 26. The computer 14 also controls the loader 90.

In the preferred embodiment, shown in FIG. 6, the loader 90 has multiple levels. Three levels 92, 94, 96 are provided in the embodiment illustrated. This allows for loading a greater volume of tubes 2, faster unloading of tubes 2 from the loader 90, and restocking of the loader 90 without disrupting the bending cycle. Each loading level or shelf 92, 94, 96 is inclined to allow the tubes 2 to slide to the front (gantry side) of a shelf 92, 94 or 96 for pickup by the pickup bar 98 disposed on a track 97, and is provided with an actuator 99 with a catch 99*a* that releases one tube 2 at a time to the front of the shelf. The pickup bar 98 rotates between a position in which pickup jaws 98*a* face the tubes 2 (generally horizontal) and a position in which pickup jaws 98*a* face the first gripper 50, and also travels vertically along the track 97, enabling the pickup bar 98 to grasp a tube 2 from any shelf 92, 94, 96 and feed it to the first (nearest) gripper 50. Although the loader 90 so described and illustrated is gravity fed, it is also possible to provide a powered loader which would load the front of each shelf using an actuator.

In operation, tubes 2 of the desired size are loaded into one or more of the three levels 92, 94, 96 of the loader 90. The pickup bar 98 grasps a tube 2 from one of the loader levels and feeds the tube 2 to the gripper 50 closest to the loader 90. The gripper 50 grasps the tube 2 at an intermediate point, and the associated crossbeam 46 moves the gripper 50 in the "x" direction toward the first bending station 20, until the tube 2 is in transverse alignment with the bending die 34. The gripper 50 then moves in the "y" direction to align the dye 34 with the specific position on the tube 2 to be bent. Preferably the tube 2 has been grasped by the gripper 50 generally centrally, minimizing the lengths of the free ends of the tube 2 extending beyond the periphery of the station 20, and thus reducing the tube bending "envelope." With the tube 2 in position for bending by the first bending station 20, the bending head 30 is moved along the "z" direction (i.e. vertically) to bring the bending dye 34 in alignment with the tube 2. The bending arm 32 is actuated to force one of the extending free ends of the tube 2 around the bending dye 34, which bends the tube 2 to the required angle and radius.

If the control program calls for further bending by the first bending station 20, the gripper 50 moves in the "y" direction to align the dye 34 with the next point on the tube 2 to be bent and the disk 62 rotates the tube 2 to the required angular orientation, so that bending along the bending plane B bends the tube 2 in the proper direction.

When the bending cycle at the first bending station 20 is complete, which may for example be when the next bend requires a dye 34 with a different radius or the tube 2 needs to be repositioned in the gripper 50, the bending head 30 is retracted to the rest position out of the path of travel of the gripper 50. The disk 62 in the next successive gripper 50 rotates until the opening in its disk 62 is facing the tube 2. The crossbeam 46 suspending the next successive gripper 50 moves in the "x" direction toward the first bending station 20, and when the tube enters the jaws 54 the jaws 54 in the next successive gripper 50 close to grasp the tube 2, and the jaws 54 in the first gripper 50 open to release the tube 2. The crossbeam 46 suspending the next successive gripper 50 then moves in the "x" direction back toward the second bending station 22, and the bending cycle commences at the second bending station 22 in the same fashion as that described above in relation to the first bending station 20.

Once the first gripper 50 has released the tube 2, the first gripper 50 returns to the loader 90 to pick up another unbent tube 2 from stock at the same time that the second gripper 54 moves over to the second bending station 22 with the partially bent tube 2*a*. One or more bends are effected at the second bending station 22, following which the third gripper 50 moves over to the second bending station 22, retrieves the partially bent tube 2*b* from the second bending station 22 and conveys it to the third bending station 24. Likewise, a partially bent tube 2*c* is retrieved from the third bending station 24 by the fourth gripper 50 and moved to the fourth bending station 26, which performs then final bends on the tube 2*c*, following which the fifth and last gripper arm 50 retrieves the completely bent tube 2*d* from the fourth bending station 26 and deposits it onto the unloading shelf 8. It will be apparent that all of the bending operations can operate in parallel in order to maximize the output of the apparatus.

The bending operation is substantially entirely controlled by a single computer 14. Typically, setting up the system 10 for a tube bending run involves roughly approximating the bends required at each bending station, programming the computer 14 to effect the bends in sequence at the designated points on the tube 2, running a number of tubes 2 through the bending system 10, and correcting any deviations from the desired finished product. When the tube bending system 10 starts to output fully bent tubes 2*d* conforming to the required specifications, a single operator can operate the tube bending system 10 simply by monitoring the bending operation at each bending station 20, 22, 24 and 26 to ensure the quality of the finished product, each tube 2 being bent identically (within established tolerances) to all previous tubes 2. The operator merely needs to ensure that the loader 90 is kept stocked with unbent tubes 2, and that no interruptions occur in the bending cycle at each of the bending stations. It is possible to monitor and even control the operation remotely, by providing a suitable communications link to the computer 14.

Various embodiments of the present invention having been thus described in detail by way of example, it will be apparent to those skilled in the art that variations and modifications may be made without departing from the invention. The invention includes all such variations and modifications as fall within the scope of the appended claims.

We claim:

1. A bending system, comprising a series of bending stations spaced from one another, each bending station comprising a bending head for bending a workpiece through a bending envelope defined along a bending plane, a series of grippers suspended from a gantry, for conveying the workpiece from one bending station to another bending station, and at least one of the bending heads being rotatable in preparation for a bend, to orient the workpiece prior to bending the workpiece to thereby adjust the position of the bending envelope relative to adjacent bending stations, whereby the bending head can be rotated to bend the workpiece without interference from adjacent bending stations.

2. The system of claim 1 wherein each bending head is rotatable.

3. The system of claim 2 wherein each bending head is rotatable because the bending stations are rotatably mounted.

4. The system of claim 1 wherein the gantry is a two-axis gantry.

5. The system of claim 4 wherein the grippers grasp the workpiece at an intermediate position of the workpiece.

6. The system of claim 1 comprising a multi-level dispensing apparatus for loading the bending heads.

7. The system of claim 6 wherein the dispensing apparatus comprises a movable loader arm for picking a workpiece off of a shelf of the dispensing apparatus and conveying the workpiece to a gripper.

8. The system of claim 1 wherein the bending system is controlled by a computer.

9. A bending system, comprising a series of bending stations spaced from one another, each bonding station comprising a bending head for bending a workpiece through a bending envelope defined along a bending plane, a series of grippers suspended from a gantry, for conveying the workpiece from one bending station to another bonding station, and a multi-level dispensing apparatus comprising a movable loader arm for picking a workpiece off of a shelf of the dispensing apparatus and conveying the workpiece to a gripper.

10. The system of claim 9 wherein the gantry is a two-axis gantry.

11. The system of claim 10 wherein the grippers grasp the workpiece at an intermediate portion of the workpiece.

12. The system of claim 9 wherein each bending head is rotatable.

13. A method of bending an elongated workpiece using a series of bending stations spaced from one another, each bending station comprising a bending head for bending a workpiece through a bending envelope defined along a bending plane, comprising the steps of:

a. rotating at least one of the bending heads to position the bending envelope so that the workpiece can be bent without interference from adjacent bending stations, b. conveying the workpiece along the series of bending stations, and c. successively bending the workpiece at each bending station.

14. The method of claim 13 wherein the step of rotating at least one of the bending heads comprises the step of rotating at least one of the bending stations.

15. The method of claim 13 wherein the step of conveying the workpiece along the series of bending stations comprises the sub-steps of, in any order, grasping the workpiece in a movable gripper and moving the gripper from one bending station to the next.

16. The method of claim 15 wherein the gripper is suspended from a gantry.

17. The method of claim 16 wherein the gantry is a two-axis gantry.

18. The method of claim 17 wherein the gripper grasps the workpiece at an intermediate position of the workpiece.

19. The method of claim 13 comprising a multi-level dispensing apparatus for loading the bending heads, further comprising the step of picking a workpiece off of a shelf of the dispensing apparatus and conveying the workpiece to a gripper.

20. The method of claim 13 wherein the bending and moving steps are controlled by a computer.

* * * * *